US007076894B2

(12) United States Patent
Santos et al.

(10) Patent No.: US 7,076,894 B2
(45) Date of Patent: Jul. 18, 2006

(54) REVERSIBLE CLEAT SYSTEM

(75) Inventors: Kenneth Daniel Santos, Taunton, MA (US); Armand Savoie, Gardner, MA (US); James E. Issler, Greenwich, CT (US)

(73) Assignee: Columbia Insurance Company, Omaha, NE (US)

( * ) Notice: Subject to any disclaimer, the term of this patent is extended or adjusted under 35 U.S.C. 154(b) by 224 days.

(21) Appl. No.: 10/759,672

(22) Filed: Jan. 16, 2004

(65) Prior Publication Data

US 2005/0155256 A1 Jul. 21, 2005

(51) Int. Cl.
*A43B 5/00* (2006.01)
*A43C 15/02* (2006.01)

(52) U.S. Cl. ..... 36/134; 36/127

(58) Field of Classification Search ..... 36/134, 36/127, 61, 62

See application file for complete search history.

(56) References Cited

U.S. PATENT DOCUMENTS 2,421,072 A * 5/1947 Kramer ..... 36/59 R
3,844,056 A 10/1974 Kwan
4,366,632 A * 1/1983 Bente ..... 36/67 D
5,033,211 A * 7/1991 Latraverse et al. ..... 36/134
5,036,606 A * 8/1991 Erich et al. ..... 36/134
5,768,809 A 6/1998 Savoie
5,926,980 A 7/1999 Adam
5,960,568 A 10/1999 Bell et al.
6,006,454 A * 12/1999 Sitzler, Sr. ..... 36/127
6,154,984 A 12/2000 Adam
2003/0172551 A1 9/2003 Spike

* cited by examiner

*Primary Examiner*—Ted Kavanaugh
(74) *Attorney, Agent, or Firm*—St. Onge Steward Johnston & Reens LLC

(57) ABSTRACT

The invention relates to a system for securing a reversible cleat having a securing mechanism, an anchoring mechanism adapted to be attached to a sole of a shoe, and a cleat having a first side and a second side and placed between the securing mechanism and the anchoring mechanism. The second side faces toward the anchoring mechanism when the securing mechanism is removably secured to the anchoring mechanism. The second side is repositioned to face away from the anchoring mechanism by removing the securing mechanism from the anchoring mechanism, removing and repositioning the cleat with the second side facing away from the anchoring mechanism, and removably securing the securing mechanism to the anchoring mechanism.

10 Claims, 15 Drawing Sheets

REVERSIBLE CLEAT SYSTEM

FIELD OF THE INVENTION

The invention relates to a shoe having a removable, interchangeable, and reversible cleat.

BACKGROUND OF THE INVENTION

In instances where improved traction may be desired, cleated shoes may have been provided because cleats may dig into a surface more easily than a flat sole. However, there may be situations where a user may wish to take off the cleated shoe, such as when the user may be leaving an athletic field and immediately entering an indoor area. In these scenarios, and in the event the user does not wish to be shoeless, the user may need to bring along another pair of shoes that do not have cleats.

Therefore, to alleviate the need for some users to carry multiple pairs of shoes, some shoes may have removable cleats where the cleats may be fastened and unfastened to a sole. U.S. Pat. No. 5,768,809 to Savoie, U.S. Pat. No. 6,154,984 to Adam, and U.S. Pat. No. 5,926,980 to Adam may provide an example of a shoe with a cleat that may be removed from the sole. Removable cleats are typically desired when a user walks to and from surfaces where cleats are and are not needed, such as indoor and outdoor surfaces. Golfers typically must remove their shoes that have cleats, which may result in some golfers being shoeless, prior to entering a club house. Therefore, a shoe with removable cleats would enable golfers to enter a club house without removing the entire shoe.

A possible disadvantage of a shoe with removable cleats is that the user may need to carry the removed cleats. A further disadvantage of the shoe with removable cleats is the user may, because the removed cleats are not fastened to the shoe, misplace one or more of the removed cleats.

Additionally, although removable cleats may allow a user to switch between a cleated sole and a flat sole, a limitation may be that the shoe does not permit cleats to be interchanged with different kinds of cleats having different limitations. A shoe with the ability to have varying types of cleats may be useful when a user encounters varying surfaces upon which traction is needed, such as when the user encounters grass, mud, and/or gravel surfaces. Rather than changing shoes or between a cleated and uncleated shoe, it may be more convenient or cost effective to simply interchange cleats. Moreover, many types of cleats may be used with a single pair of shoes that permits the cleats to be interchanged, which may permit improved versatility, convenience, and cost effectiveness.

U.S. Patent Application Publication No. US2003/0172551 to Lee appears to show a cleat that is rotatable. However, the rotatable cleat does not appear to be interchangeable or removable. Therefore, the shoe may be limited to two types of cleats. Moreover, Lee may be limited to a cleated shoe where the cleats are typically employed on a continuous basis.

What is desired, therefore, is a shoe with a cleat that may be removed and interchanged with another type of cleat. What is also desired is a shoe that permits multiple types of cleats to be interchanged with one another to improve versatility, convenience, and cost effectiveness. A further desire is a shoe that permits cleats to be interchanged while reducing the likelihood of misplacing or losing cleats that are not being used.

SUMMARY OF THE INVENTION

Therefore, it is an object of the invention to provide a cleat that is removable and interchangeable with another cleat.

It is also an object of the invention to provide a shoe that permits cleats to be interchangeable with other cleats having different limitations.

It is a further object of the invention to provide a shoe that utilizes a plurality of cleats, where each cleat has a first end that has different limitations from a second end and where a user may select either end to be used on a walking surface.

It is yet another object of the invention to provide a shoe that may be worn with or without cleats.

Still another object of the invention is to provide a shoe that utilizes a plurality of removable and interchangeable cleats, where each cleat has a first end having different limitations from a second end and where all cleats have different limitations from one another.

These and other objects of the invention are achieved by a system for securing a reversible cleat having a securing mechanism, an anchoring mechanism adapted to be attached to a sole of a shoe, and a cleat having a first side and a second side and placed between the securing mechanism and the anchoring mechanism. The second side faces toward the anchoring mechanism when the securing mechanism is removably secured to the anchoring mechanism. The second side is repositioned to face away from the anchoring mechanism by removing the securing mechanism from the anchoring mechanism, removing and repositioning the cleat with the second side facing away from the anchoring mechanism, and removably securing the securing mechanism to the anchoring mechanism.

The system may also include, in a first position, the securing mechanism being in contact with the first side when secured to the anchoring mechanism and, in a second position, the securing mechanism being in contact with the second side when secured to the anchoring mechanism.

Additionally, the cleat may include a rigid material having a first side and a second side corresponding to the first and second sides of the cleat. The securing mechanism may further contact the first and second sides of the rigid material when removably securing the cleat to the anchoring mechanism.

In some embodiments, the system may include a plurality of cleats, each cleat of the plurality of cleats being selectable and removably interchangeable with one another.

DETAILED DESCRIPTION OF THE DRAWINGS

Figure 1A:
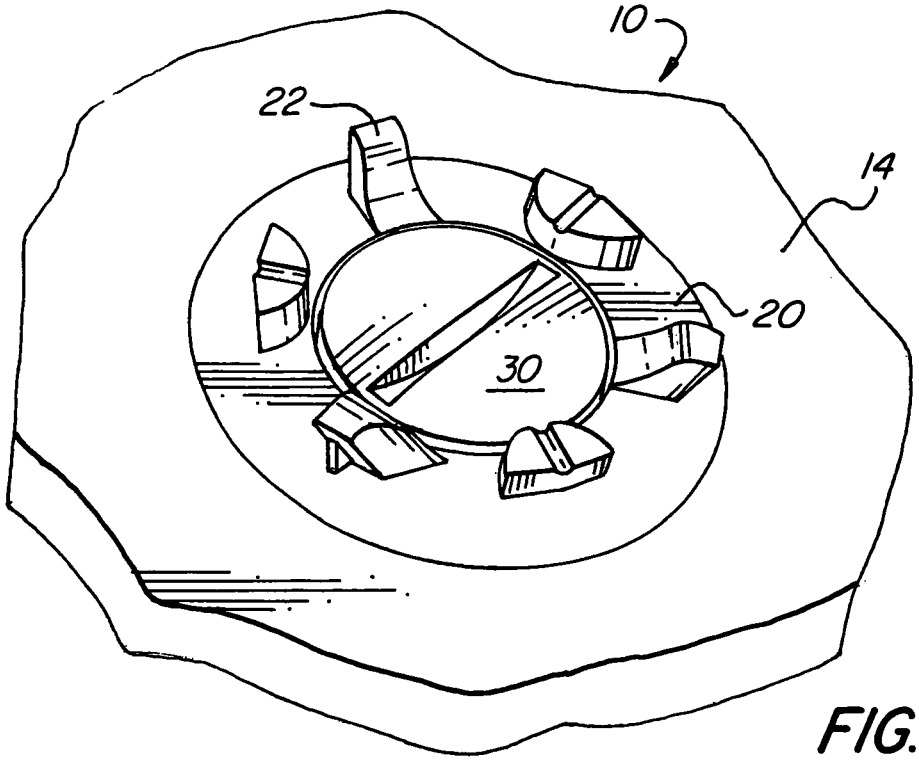
FIG. 1*a* is an isometric view of the invention where the first side of the cleat is facing upwards.
Figure 1B:
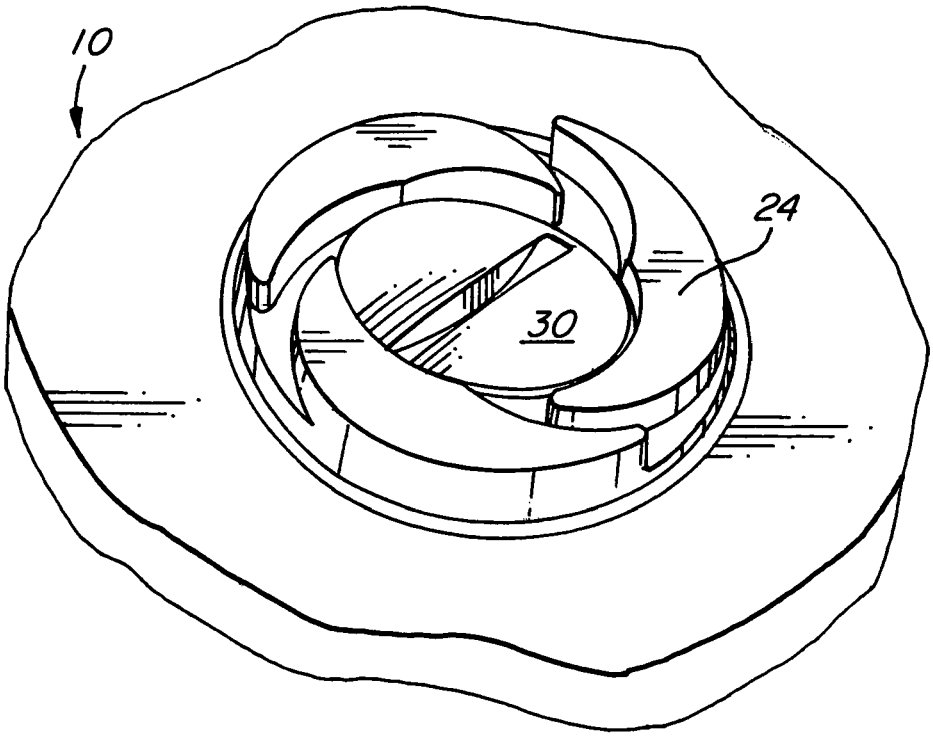
FIG. 1*b* is an isometric view of the invention where the second side of the cleat is facing upwards.

FIGS. 1*a* and 1*b* depict the system 10 for securing a reversible cleat 20 in accordance with the invention. As shown, cleat 20 may be positioned with either first side, FIG. 1*a*, or second side, FIG. 1*b*, being exposed and extending away from sole 14 of a shoe. Although cleat 20 is shown to extend in an upward direction, it is understood that sole 14 represents a bottom of a shoe and, when being worn by a user, cleat 20 extends in a downward direction toward a walking surface. Cleat 20 is shown to extend in an upward direction for the purpose of facilitating the depiction of all the components of system 10.

Figure 2:
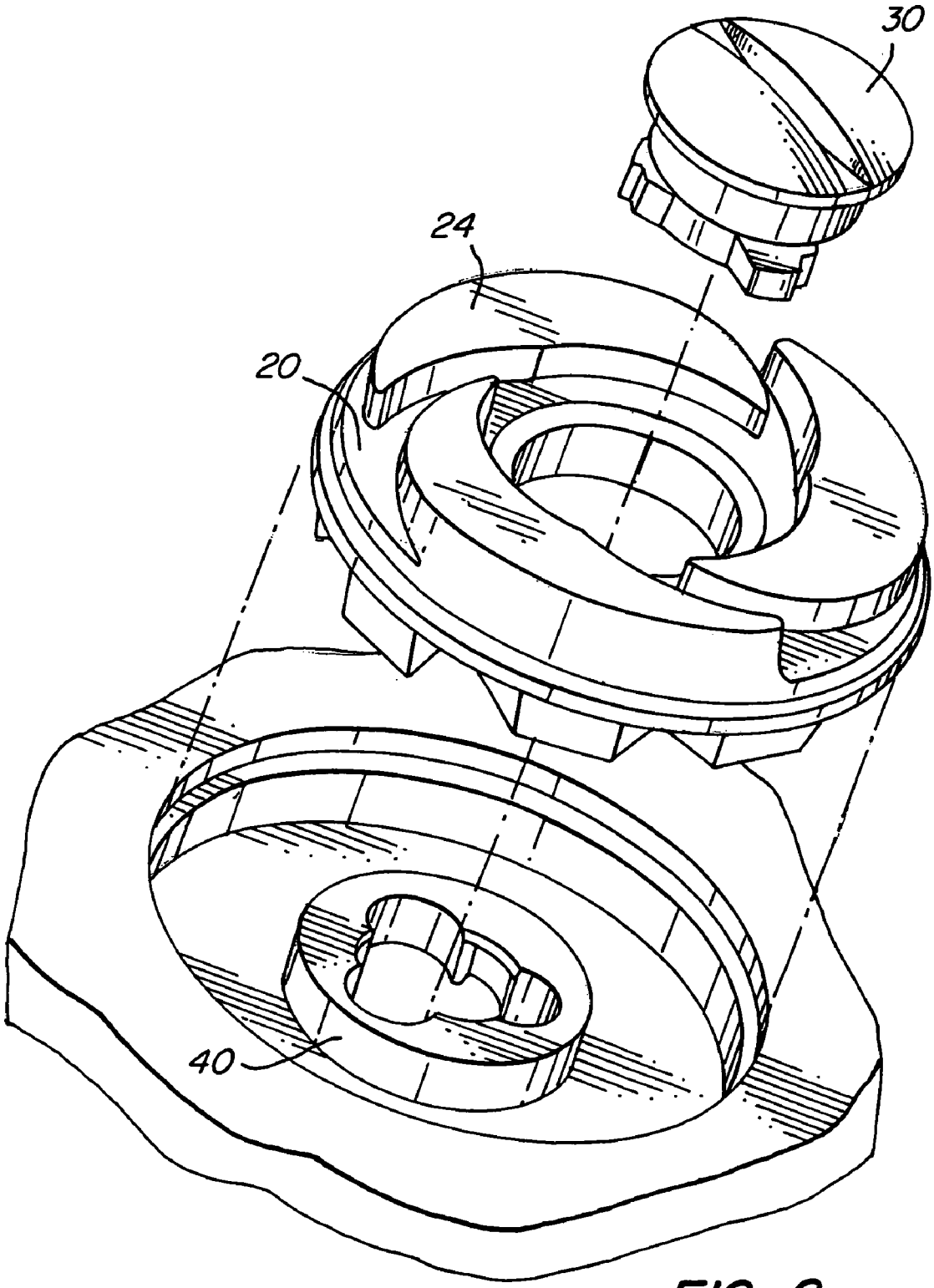
FIG. 2 is an assembly view of the system for securing a cleat.
Figure 3A:
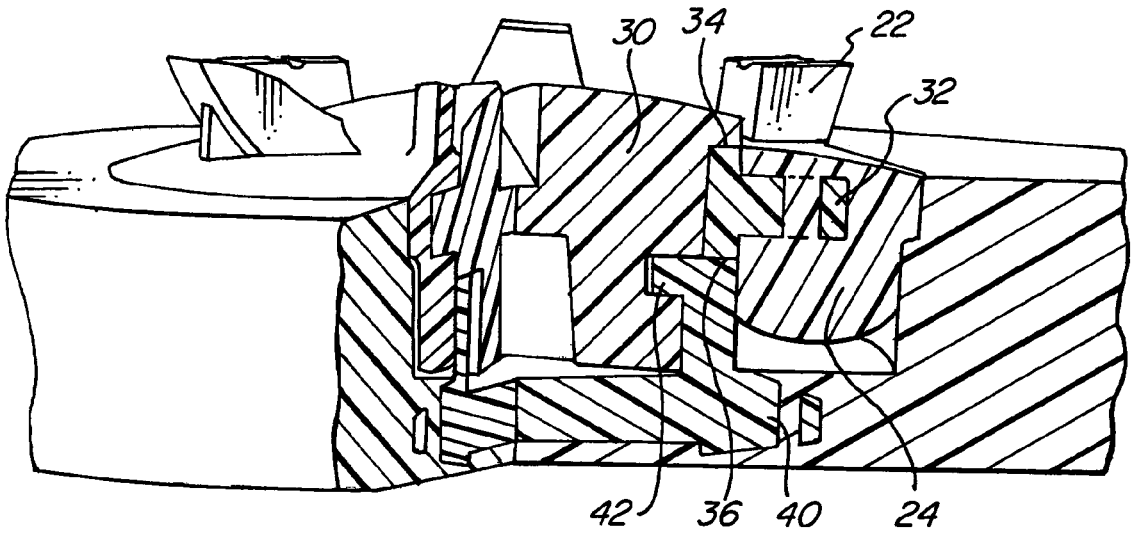
FIG. 3*a* depicts a cross sectional view of the system of FIG. 1*a*.
Figure 3B:
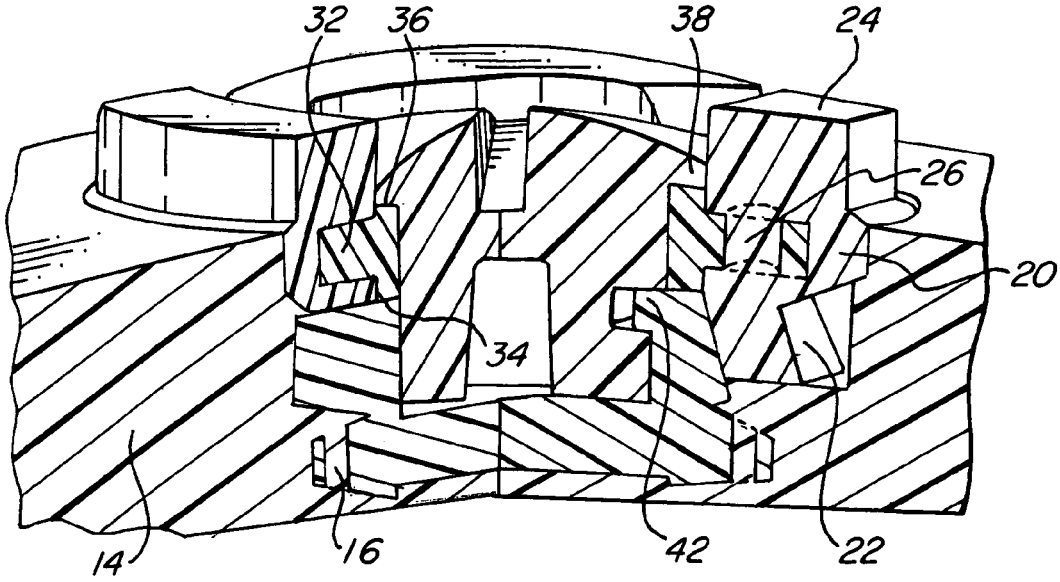
FIG. 3*b* depicts a cross sectional view of the system of FIG. 1*b*.

System 10 further includes securing mechanism 30, which removably secures cleat 20 to anchoring mechanism 40 (shown in FIGS. 2, 3*a*, and 3*b*). Securing mechanism 30 is removably attached or secured to anchoring mechanism 40 by any known or novel manners for securement. In some embodiments, threads are used to engage securing mechanism 30 to anchoring mechanism 40. In further embodiments, fasteners are used. In still other embodiments, adhesives are used. The manner securing mechanism 30 is removably secured to anchoring mechanism 40 should not be a limitation on system 10. All that is required is that securing mechanism 30 be removably secured to anchoring mechanism 40.

As shown, securing mechanism 30 is removably secured to anchoring mechanism 40 so that cleat 20 may be removed, interchanged, and/or reversed. In reference to FIGS. 3*a* and 3*b*, which represents cross sectional views of system 10 shown in corresponding FIGS. 1*a* and 1*b*, respectively, cleat 20 has a first side with at least one extension 22 of a first type and cleat 20 has a second side with at least one extension 24 of a second type. Both the first and second types of extensions have different limitations for the purposes of engaging with different types of walking surfaces. In this fashion, a user need not carry or purchase two different types of cleats or two different types of shoes. To reverse cleat 20 from the first side to the second side, the user merely needs to remove securing mechanism 30 from anchoring mechanism 40, which would enable the user to then remove and reverse cleat 20 from the position shown in FIG. 1*a* to the position shown in FIG. 1*b*, and then reattach securing mechanism 30 to anchoring mechanism 40.

Cleat 20 has the benefit of being two cleats in one because the at least one extension 22 of the first type has different limitations than the at least one extension 24 of the second type. A variation of this embodiment may entail having both the at least one extension 22 of the first type have the same limitations as the at least one extension 24 of the second type. Hence, when a first side becomes worn, broken, or otherwise unusable, the second side may be used.

In another embodiment, a plurality of cleats may be provided, each cleat of the plurality of cleats being a different type, or having varying limitations, from other cleats of the plurality of cleats. Each cleat of the plurality of cleats is also interchangeable from cleat 20. This embodiment permits the user to be able to remove cleat 20 from anchoring mechanism 40, select a cleat from the plurality of cleats, and interchange cleat 20 with the selected cleat. Moreover, both cleat and the selected cleat may be reversible in addition to being interchangeable and removable. This embodiment enhances the versatility of the shoe because a single shoe may utilize multiple types of cleats when the user encounters multiple types of walking surfaces.

As shown in FIGS. 3*a*–3*b*, rigid material 32 is permanently attached to cleat 20 and has a higher hardness than cleat 20 to provide structurally integrity to cleat 20 so that cleat 20 may be secured to anchoring mechanism 40 by securing mechanism 30. Without rigid material 32, and if rigid material 32 were replaced with the same material used to provide cleat 20, cleat 20 may flex around, due to walking, head 38 of securing mechanism 30 and accidentally separate from system 10. As shown, rigid material 32 is integrally formed with cleat 20, where rigid material 32 may have an orifice through which vertical member 26 of cleat material passes during fabrication of cleat 20 and rigid material 32.

Rigid material 32 includes a first shoulder 34 and a second shoulder 36 where securing mechanism 30, when removably secured to anchoring mechanism 40 to secure cleat 20 in a position where the first side faces away from sole 14, compresses against first shoulder 34 and anchoring mechanism 40 compresses against second shoulder 36 (see FIG. 3*a*). When the second side faces away from sole 14, securing mechanism 30 compresses against second shoulder 36 and anchoring mechanism 40 compresses against first shoulder 34 (see FIG. 3*b*). As shown, head 38 of securing mechanism 30 makes contact with and compresses against either first or second shoulder, 34 and 36, and shoulder 42 of anchoring mechanism 40 makes contact with and compresses against either first or second shoulder, 34 and 36.

In addition to providing structural integrity to cleat 20, rigid material 32 also provides proper placement, in an axial direction, of the at least one extension for both the first and second sides of cleat 20. It is envisioned that first and second shoulders 34 and 36 are, in an axial direction, equidistant from the furthest points of both the at least one extension of the first and second sides of cleat 20. Being equidistant, or centrally located in the axial direction, between the outermost points of both the at least one extension of the first and second sides of cleat 20, both the at least one extension of the first and second sides extend away from sole 14 the same distance as one another. Therefore, when switching between the first and second sides, the fit of the shoe is consistent.

If, for example, the first and second shoulders, 34 and 36, are located more toward the first side, and when the user switches from the first to the second side, the user may experience that the cleats extend farther on the second side than the first side. This may be desirable in some embodiments, such as when a user encounters a muddy terrain and longer cleats are beneficial.

It is not necessary that first and second shoulders, 34 and 36, have a particular surface area or geometry. The design of first and second shoulders 34 and 36 are shown in the figures for exemplary purposes. All that is required of first and second shoulders 34 and 36 is that they have a location against which it may be compressed by either securing mechanism 30 or anchoring mechanism 40. The location may be a single contact point, line contact, or surface.

In other embodiments, rigid material 32 is removable from cleat 20 so that cleat 20 may be replaced when worn and rigid material 32 would not need to be discarded, which is often the result when rigid material 32 is permanently or integrally formed with cleat 20.

Also, FIGS. 3*a* and 3*b* show anchoring mechanism 40 permanently attached to sole 14. In some embodiments, anchoring mechanism 40 may be integrally formed with sole 14, where anchoring mechanism 40 may have an orifice through which vertical member 16 of sole material passes during fabrication of sole 14 and anchoring mechanism 40.

Optionally, a quick release mechanism may be used to removably secure securing mechanism 30 with anchoring mechanism 40. The quick release mechanism that may optionally be employed is shown in FIGS. 4–23.

Figure 4:
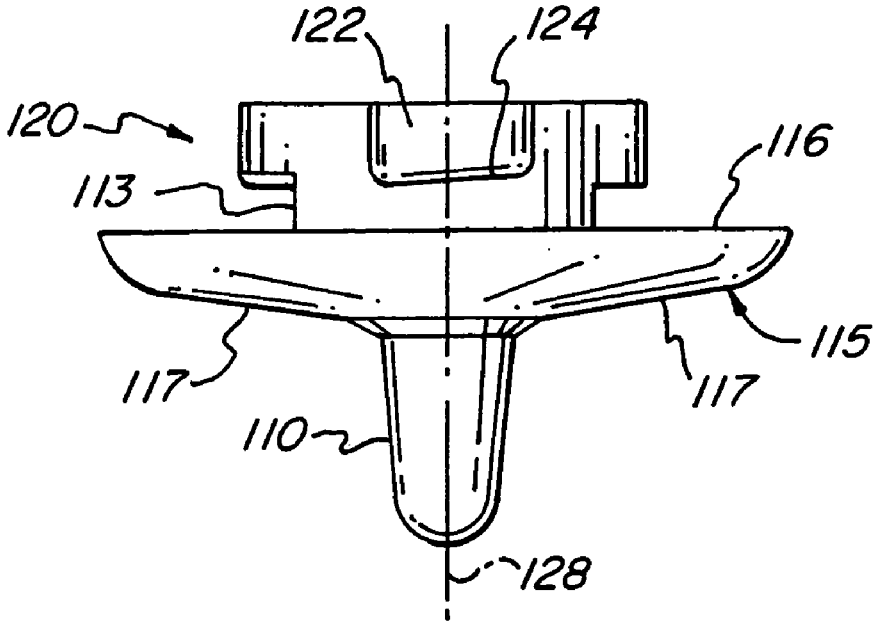
FIG. 4 is a side view of a cleat according to one embodiment of the invention.

FIG. 4 shows bottom side 117 and top side 116 of the plastic skirt 115, the ground-engaging head portion 110 of the cleat, a base 113 to which the plastic skirt and ground-engaging portion are attached and a retaining member 120, which in this case is a base 113 with three rounded extensions 122, all of which are positioned around a central axis 128. In a preferred embodiment of the invention, the top 116 of the skirt 115 is slightly concave, and the bottom 117 of the skirt 115 is somewhat convex.

Figure 5:
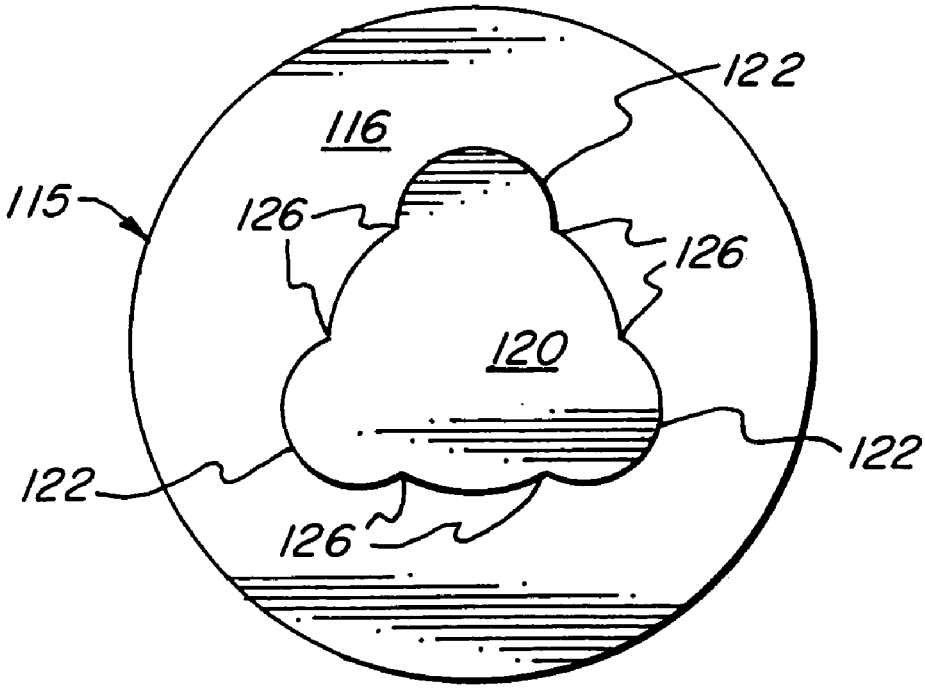
FIG. 5 is a top view of the cleat of FIG. 4, showing the shape of the lobes to be inserted into a mated receptacle in the bottom of athletic footwear.
Figure 8:
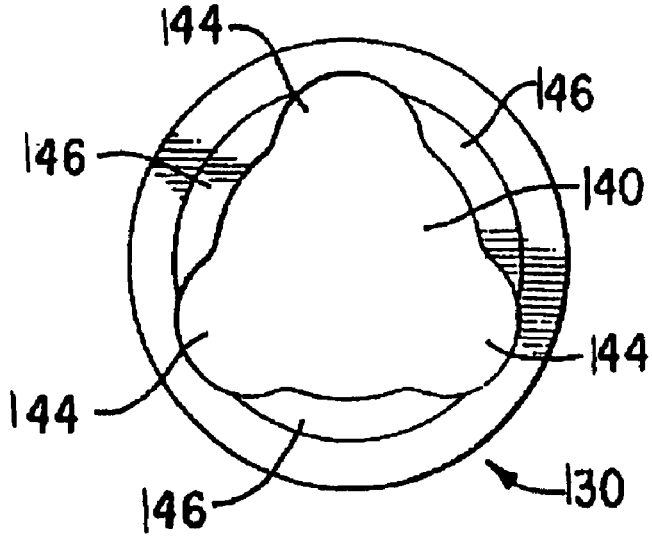
FIG. 8 is a bottom view of a receptacle that may receive the FIG. 4 cleat.
Figure 9:
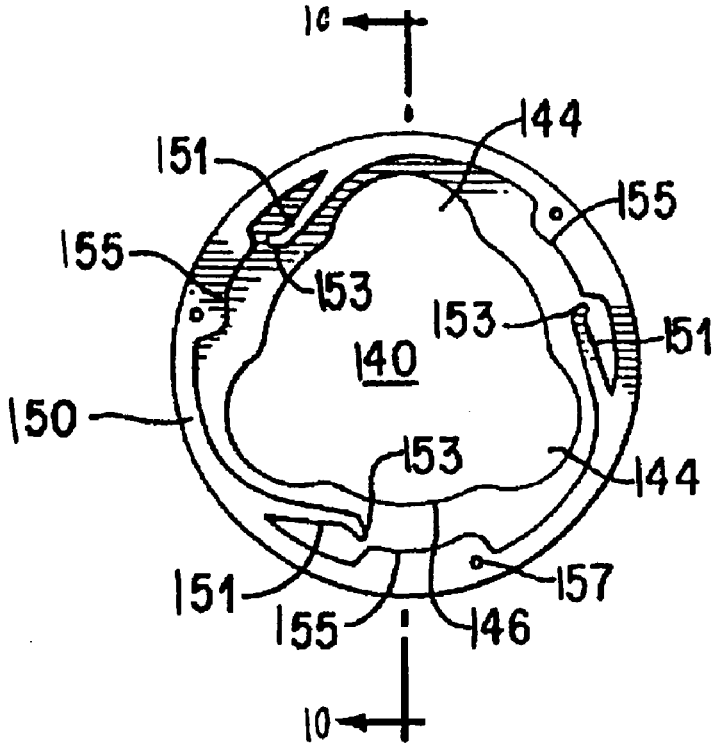
FIG. 9 is a top section view of the FIG. 8 receptacle wherein the top layer of the receptacle has been removed.

FIG. 5 shows the topside 116 of the cleat skirt 115 and the retaining member 120, which has a roughly triangular shape with indentations 126. The extensions 122 of the retaining member 120 are used in conjunction with components inside the receptacle, shown as item 130 in FIG. 8, for locking in place a properly inserted retaining member 120. Locking in place occurs after inserting the retaining member 120 into a mated receptacle opening 140 as shown in FIG. 8 and FIG. 9, and torquing the retaining member. The extensions 122 are attached to the base 113 (shown in FIG. 4), and together the extensions and the base form the retaining member 120. In a preferred embodiment of the quick release mechanism, a completed cleat, comprising the retaining member 120 and traction gear, is made out of plastic with a metal core used to reinforce the structure. Although the quick release mechanism could be made entirely out of metal, it is preferable that the cleat be made partially of plastic and partially of metal. When the retaining member is plastic, the retaining member may be integrally formed with a plastic skirt of a golf cleat with a core, preferably metal, extending through the retaining member and the traction gear to form the ground-engaging head portion 110 shown in FIG. 4.

In a preferred embodiment of the invention, upon insertion of the retaining member 120 into a receptacle, the angled surface 124 (shown in FIG. 4) of the extensions 122 allows for a tighter fit of the retaining member 120 into the receptacle 140 (shown in FIG. 8). The tight connection not only serves to give a stable connection between the shoe and traction gear, but also serves to keep moisture and debris out of the attachment system.

Figure 6:
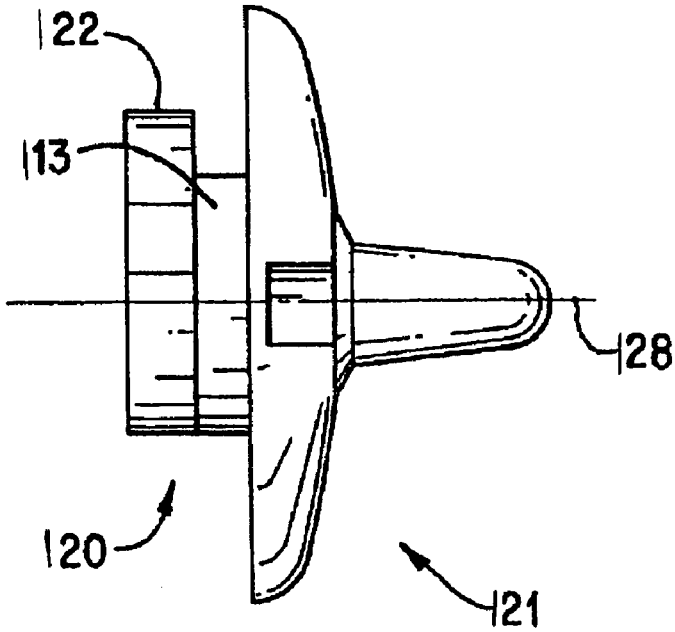
FIG. 6 is another side view of the cleat of FIG.4.

FIG. 6 is another view showing the structure and proportion of the retaining member 120 as attached to traction gear 121. FIGS. 5 and 6 show that in a preferred embodiment of the invention, the extensions 122 form a broad retaining member 120, and the base 113 is cylindrical and concentrically disposed around the center axis 128; the base 113 is attached to the extensions 122 and the traction gear 121.

Figure 7:
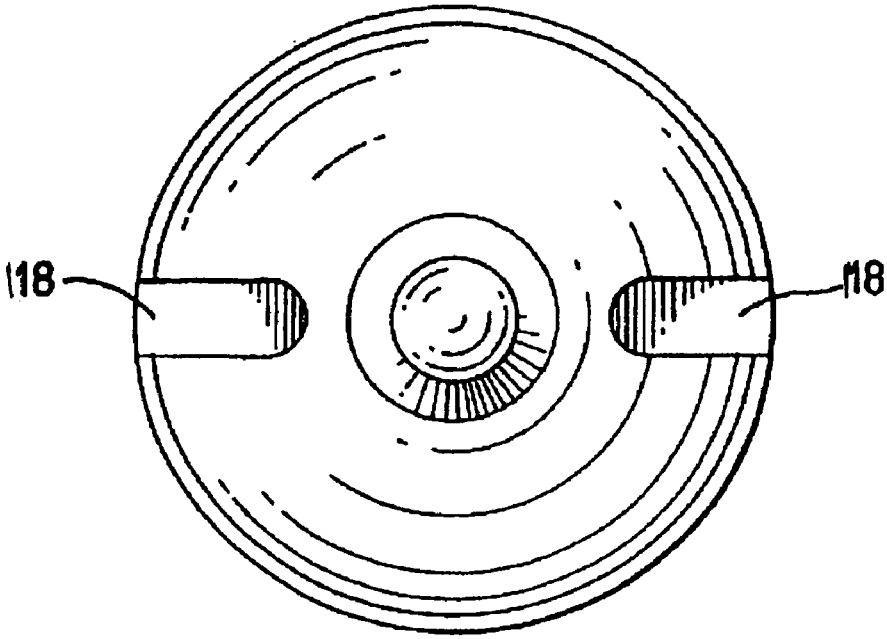
FIG. 7 is a bottom view of the cleat of FIG. 4.

FIG. 7, a bottom view of the FIG. 4 cleat, shows that, in a preferred embodiment of the quick release mechanism, cleats do not have to be redesigned beyond modifying the retaining member 120 (shown in FIG. 4), and that conventional cleat designs are intended to be used in conjunction with the new retaining member; once a cleat is installed, the change in the retaining system is not apparent. A standard golf-cleat wrench may be used to engage the traction gear through use of the wrench holes 118.

FIG. 6 is a bottom view of a receptacle 130 that may receive the FIG. 4 cleat, showing the receptacle opening 140, with indentations 144 along its perimeter for accepting the retaining member extensions 122 (shown in FIG. 4). FIG. 8 also shows the ledges 46 that while serving to form the shape of the opening 140, also serve to hold the extensions 122 within the receptacle. Although preferred embodiments of the invention include a single receptacle opening 140, alternate embodiments of the system could have a receptacle with separate openings for receiving extensions.

FIG. 9 is a section view of FIG. 8 where the top layer of the receptacle has been removed to show the inner-cavity structure for receiving the retaining member 120 (shown in FIG. 4). Within the cavity, formed by wall portion 150, there are several cantilevered fingers 151, or spring arms, that are designed to grip and hold an installed retaining member. When a retaining member is inserted into the indentations 144 and twisted, the twisting action causes a protruding edge of an extension 122 (shown in FIG. 4) to push into and bend the finger 151 to allow the extension to be turned past the location of the finger. Once the protruding edge of an extension passes the location of the finger, the finger springs back to nearly its original shape, so that surface 153 rests against the perimeter of the extension 122. This allows the cleat to be removed, but only by exerting sufficient force to bend the finger 151 away from the surface of the extension 122, an arrangement requiring much greater torque than that required during installation of the retraining member. In one embodiment, the fingers are elongated in shape, with surface 153 forming a curved tip to the finger. FIG. 9 also shows bumps 155 which serve as a means for preventing a retaining member from being turned too far. In a preferred embodiment, the cleat should not be turned more than about 60°. Coincident with the fingers 151 locking into place, the protruding edge of an extension is blocked from further movement by the bumps 155, and the entire retaining system is prevented from falling out of the receptacle by ledges 146. FIG. 6 also shows one method of attaching the receptacle to the underside of footwear by the use of mounting holes 157.

Spacing within the receptacle may be designed such that during installation of a cleat, the receptacle opening 140 in which the extension is turned gradually narrows to compress and securely hold the cleat in place. Preferably the spacing is consistent or more gradual than the angled surface, so that the angled surfaces 124 (shown in FIG. 4) of the extension 122 being pressed against the ledges 146 cause the fit to be tight. In addition, having three extensions parallel to the cleat skirt makes for a more secure base for a cleat.

Figure 10:
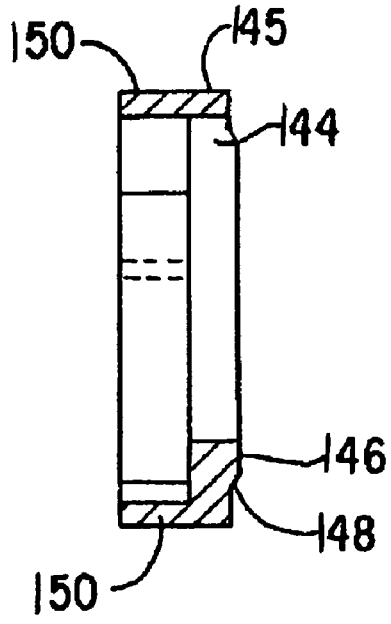
FIG. 10 is a side vertical section of the receptacle of FIG. 9.

FIG. 10 is a vertical section of a portion of the embodiment of the receptacle of FIG. 9. This view shows the ledge 146 formed by the bottom layer 145 of the receptacle and the wall portion 150 that defines the cavity within the receptacle. This view also shows the slight rise 148 which forms a lip at the receptacle opening so that the edge of an installed cleat's skirt may overlay the lip. The lip helps hold the cleat in place and makes it more resistant to lateral forces while the cleat is in use.

Figure 11:
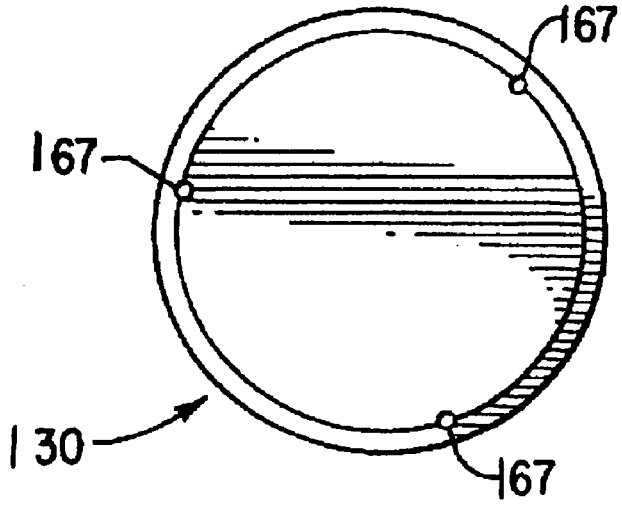
FIG. 11 is a top view of the FIG. 9 receptacle wherein the top layer has not been removed.

FIG. 11, which is the FIG. 9 receptacle where the top layer has not been removed, is a view from the top of the receptacle 130 in accordance with a preferred embodiment of the invention. This view shows the top side 167 of the mounting holes for attaching the receptacle.

Figure 12A:
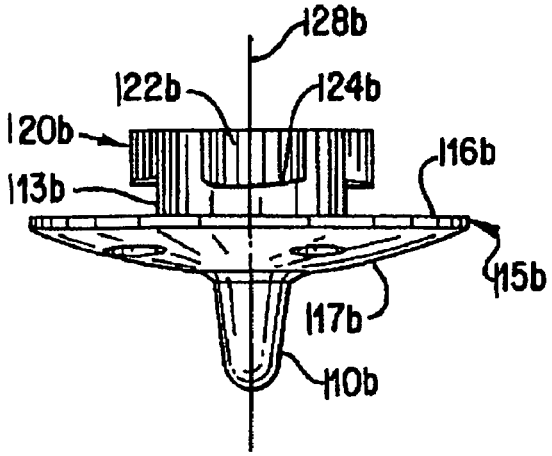
FIG. 12A is a perspective right side view of a cleat according to a preferred embodiment of the invention.
Figure 12B:
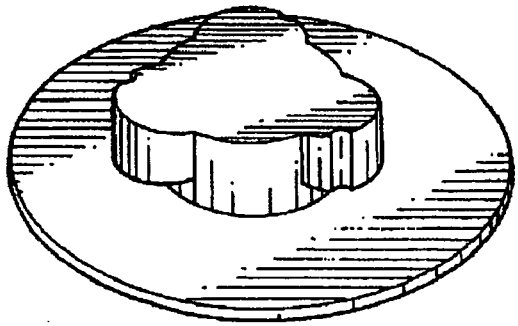
FIG. 12B is a perspective top view of the FIG. 12A cleat.
Figure 12C:
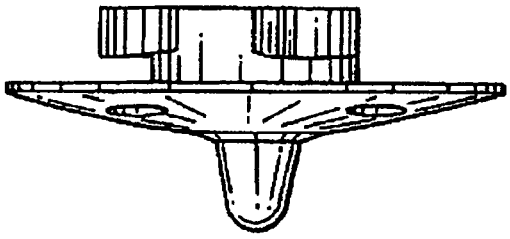
FIG. 12C is a perspective front view of the FIG. 12A cleat.
Figure 12D:
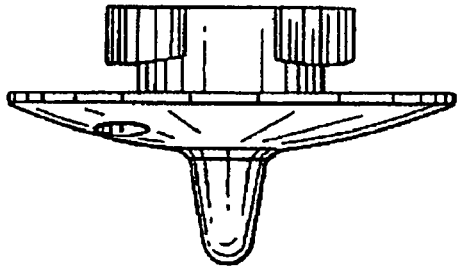
FIG. 12D is a perspective left view of the FIG. 12A cleat.

FIGS. 12A–12D, 13 and 14 show a preferred embodiment of a cleat having the same basic characteristics and structural concerns of the FIGS. 4, 5, and 6 embodiments discussed hereinabove. Evident in FIG. 12A are the bottom side 117*b* and top side 116*b* of the plastic skirt 115*b*, the ground-engaging head portion 110*b* of the cleat, a base 113*b* to which the plastic skirt and ground-engaging portion are attached and a retaining member 120*b*, which in this case is a base 113*b* with three rounded extensions 122*b*, the extensions having an angled surface 124*b* and being positioned around a central axis 128*b*. FIGS. 12B–12D are respectively the perspective top, front, and left view of the FIG. 12A cleat.

Figure 13:
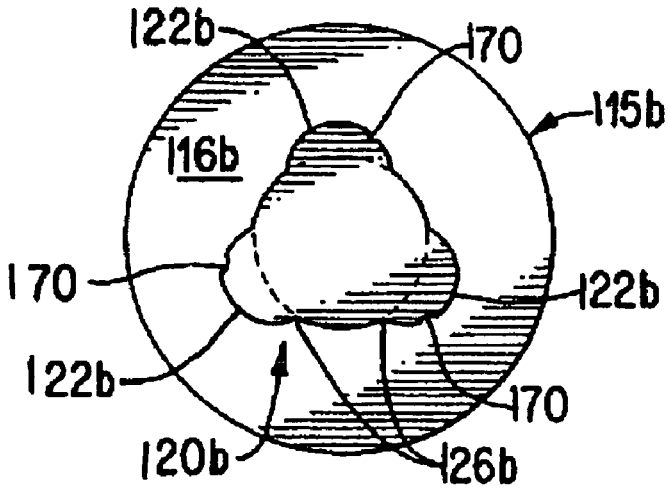
FIG. 13 is a top view of the cleat of FIG. 12A, showing the shape of the lobes to be inserted into a mated receptacle in the bottom of athletic footwear.

Evident in FIG. 13 are the corresponding topside 116*b* of the cleat skirt 115*b* and the retaining member 120*b*, with indentations 126*b*. The extensions 122*b* of the retaining member 120*b* are used in conjunction with components inside the receptacle 184 of FIG. 15A, for locking in place a properly inserted retaining member 120*b*. Locking in place occurs after inserting the retaining member 120*b* into a mated receptacle opening 140*b* shown in FIG. 15A, and torquing the retaining member. As with the FIG. 4 embodiment, upon inserting the retaining member 120*b* into a receptacle 184, the angled surface 124*h* (shown in FIG. 12A) of the extensions 122*b* forces a gradual compression of the retaining member 120*b* as it is inserted into the receptacle opening 140*b*, resulting in a tight connection giving stability while also serving to keep moisture and debris out of the attachment system.

Also evident in the FIG. 13 embodiment is a modification to the FIG. 5 embodiment, where the extensions 122 of FIG. 5 are modified to include an indentation 170 that further enhances the invention's resistivity to unlocking and its unintentional removal through normal use. Increased resistivity is effected by an interlocking of a cantilevered finger 174 (shown in FIG. 19) with the indentation 170. The cantilevered finger 174 corresponds to the cantilevered finger 151 of the FIG. 9 embodiment, in which the cantilevered finger 151 has been thickened to afford a greater resistivity to unintentional unlocking. Further, upon complete insertion of the retaining member 120*b* into an appropriate receptacle 184 (shown in FIG. 15A), the end portion 190 of the cantilevered finger 174 rests within the indentation 170. Consequently, removal of the cleat requires greater torque than that required to install the cleat.

Figure 14:
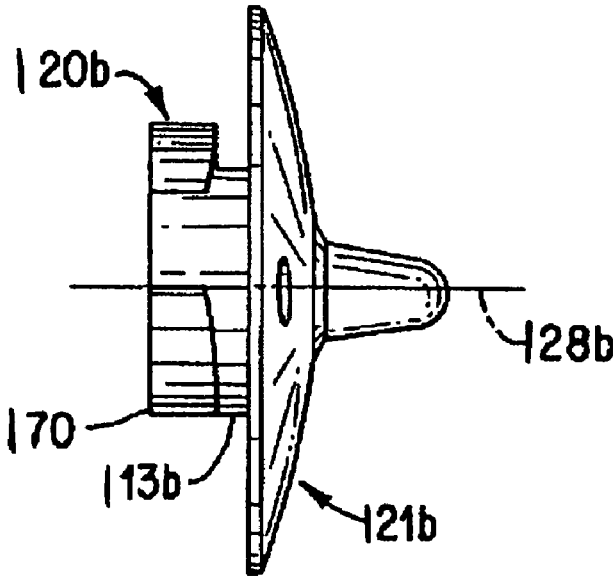
FIG. 14 is another side view of the cleat of FIG. 12A.

FIG. 14 is another view showing the structure and proportion of the retaining member 120*b* as attached to traction gear 121*b*, indicating the location of indentation 170, as well as showing that the placement of the retaining member 120*b* and base 113*b* is concentrically disposed around the center axis 128*b*.

Figure 15A:
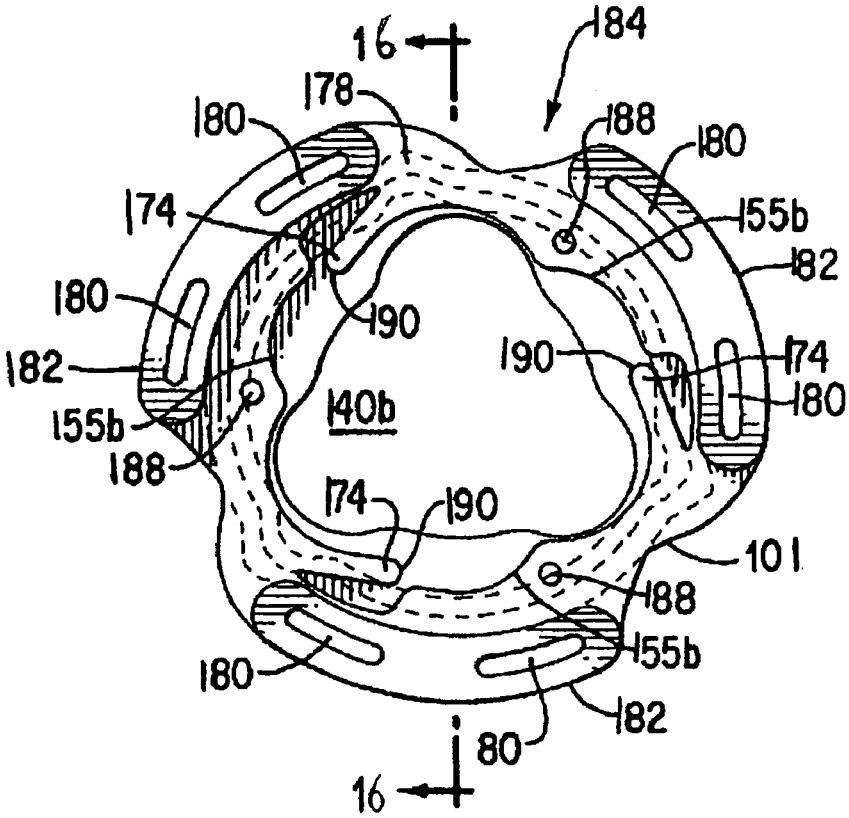
FIG. 15A is a top section view of a the receptacle for receiving the cleat of FIG. 12A, wherein the top layer of the receptacle has been removed.
Figure 15B:
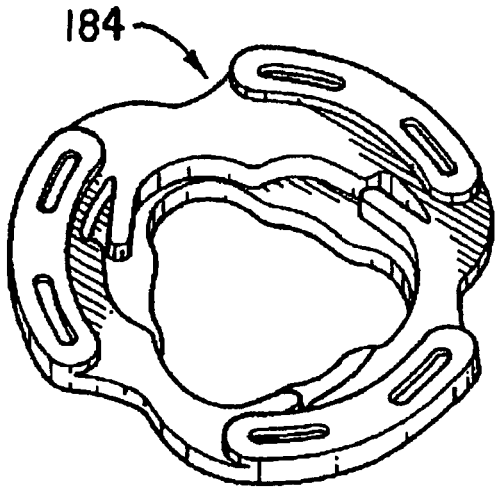
FIG. 15B is a perspective bottom view of the FIG. 15A receptacle.

FIG. 15A is a section view of a preferred embodiment of a receptacle for receiving the cleat of FIGS. 12A–12D, 13 and 14, where the top layer of the receptacle 184 has been removed to show the inner-cavity structure for receiving the retaining member 120*b* (shown in FIG. 12A). FIG. 15B shows a perspective view of the FIG. 15A receptacle. As with the FIG. 9 embodiments, included within the cavity, formed by wall portion 178, are several cantilevered fingers 174 designed to grip and hold an installed retaining member 120*b*. When a retaining member is inserted and twisted, the twisting action causes a protruding edge of an extension 122*b* to push into and bend the finger 174 to allow the extension to be turned past the location of the finger. Once the protruding edge of an extension passes the location of the finger 174, the finger springs back to nearly its original shape, so that end portion 190 contacts the perimeter of the extension 122*b*. As described hereinabove, when the end portion 190 contacts extension 122*b*, there is an interlocking of cantilevered finger 174 with the indentation 170 (shown in FIG. 13). This allows the cleat to he removed, hut only by exerting sufficient force to disengage and bend finger 174 away from indentation 170 and the surface of the extension 122*b*, an arrangement requiring much greater torque than that required during installation of the retaining member. As with the FIG. 9 embodiment, the fingers are preferably elongated in shape, end portion 190 forms a curved tip to the finger, and bumps 155*b* serve as a means for preventing a retaining member from being turned too far during insertion.

Also evident in the FIG. 15A receptacle is another preferred embodiment for attaching the receptacle 184 to the underside of footwear by the use of a mounting slot 180. In this embodiment, the perimeter 101 of the receptacle 184 comprises three flanges disposed around the receptacle opening 140*b*. In preferred embodiments, within each flange 182 of the perimeter are two slots 180 for mounting the receptacle 184 to footwear. Mounting of the receptacle is by methods known in the prior art, and may include forming sole material around the slots, or inserting a pin or other object through the slot to effectively nail the receptacle to an inner-sole of a shoe, and then forming the outer-sole material around the receptacle so affixed. The slots 180 are separated by a pre-determined distance and are preferably curved to conform to the curvature of the flange 182 in which the slot 180 is set. Also shown are three openings 188 to allow for attaching a receptacle cover 196 (shown in FIG. 17) to the receptacle 184.

Figure 16:
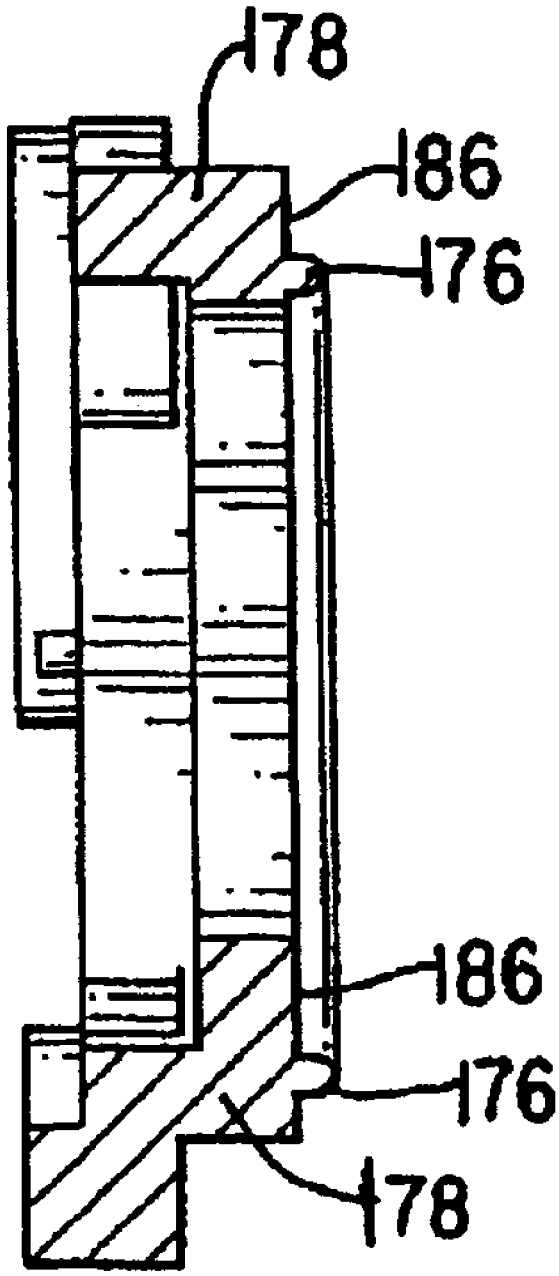
FIG. 16 is a side vertical section of the receptacle of FIG. 15A.

FIG. 16 is a vertical section of a portion of the embodiment of the receptacle of FIG. 15A. The FIG. 16 embodiment has a ridge 176 has been added in the bottom layer 186 of the wall portion 178 of the receptacle. In this preferred embodiment, the ridge 176 is located upon the downward side of the receptacle and helps assure mold seal-off. Sealing off the mold helps prevent sole material from the outsole molding process from accidentally spilling in over the bottom-end of the receptacle during production. (The receptacle and outsole are preferably molded ground-side up.) In addition, by adding ridge 176 to the basic design of FIG. 9, the structure of the FIG. 9 receptacle is strengthened, making it less susceptible to torques, distortions, or other forces. This results in better retention of the receptacle within the sole of athletic footwear.

Figure 17:
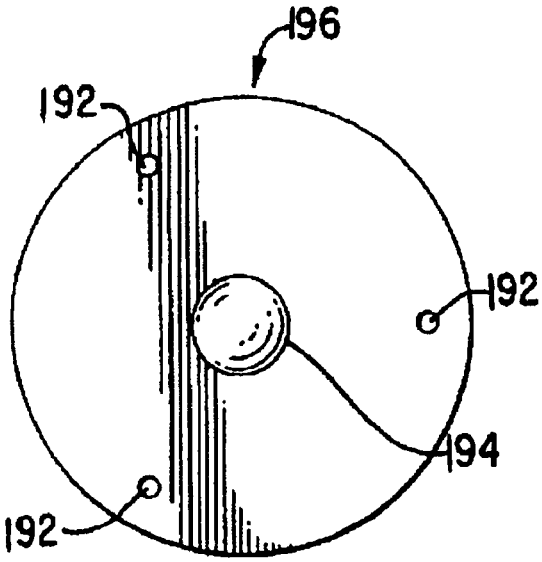
FIG. 17 is a bottom view of a cover for the FIG. 15A receptacle.

FIG. 17 shows a receptacle cover 196 having three holes 192 corresponding to the three openings 188 shown in FIG.

15. In preferred embodiments, the receptacle cover is designed to attach to and seal the top end of the receptacle 184 of FIG. 15A, so that during molding of a shoe sole around the receptacle, the sole material does not seep under the top edge of the receptacle and fill its cavity. In addition, at the center of the cover 196 is a dome 194. This dome hangs downward from the top of the receptacle, into the receptacle cavity for receiving a retaining member 120*b* (shown in FIG. 12A).

Figure 18:
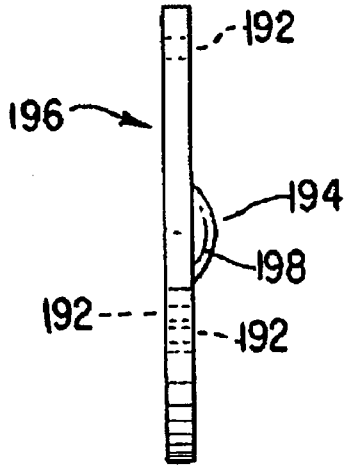
FIG. 18 is a side view of FIG. 17 cover.

FIG. 18 shows a side view of the FIG. 17 cover, indicating the extent of the dome 194 with respect to the rest of the cover's 196 proportions. The dome forms a cavity 198 between a sole of a shoe and the top of the receptacle 184 (shown in FIG. 15A). In preferred embodiments, during manufacture of a shoe sole, in addition to sole material being molded around the receptacles, sole material is also allowed to fill in the cavity 198. Consequently, as a retaining member 120*b* (shown in FIG. 12A) is inserted into a proper receptacle, the insertion forces a compression of the dome which in turn compresses the sole material filling the dome. The dome 194 serves two purposes. First, when the retaining member 120*b* of traction gear is fully installed within a receptacle 184 (shown in FIG. 15A), the compression of the dome results in a downward pressure upon the extensions 122*b* from the dome trying to re-expand into its original shape. Second, when one tries to remove the traction gear from the receptacle 184, the re-expansion of the sole material helps push the retaining member away from the sole, thus aiding in the removal of attached gear.

In preferred embodiments, the extensions for the attachment system are molded using conventional molding processes. Preferably, the molding process uses mold components having expandable cavities, these cavities allowing for undercuts to be molded without the use of side actions or slides. The receptacle may be molded using conventional molding processes, where the receptacles are preferably produced on a horizontal or vertical press and, with the aid of precision mold design and building, are formed in a manner well-known in the art.

In preferred embodiments of the invention, during manufacture, the receptacle portion with the top cover attached is placed in an outsole mold, and the ground surface part of a shoe is then molded. The molding process is preferably one of injection or compression molding. The particular location of each receptacle within the mold depends on the intended use of the shoe and the design of the shoe's shape. During manufacture of the outsole of one embodiment of the invention, mold support-braces may be used to help ensure no deformation of the receptacles during the molding of the sole. Preferably, the support-braces are negatives of the receptacle's shape such that when a brace is inserted into a receptacle, the receptacle 184 and pin holes 188 (shown in FIG. 15A) are temporarily sealed off to prevent sole material from filling in the receptacle opening 140*b* and pin holes 188. These pins may also be used to help orient and position the receptacle so that sole material flows up to and not beyond the ridge 176 (shown in FIG. 16) that is visible on the ground side of the receptacle. Once the outsole is molded, a second material may be molded or cemented to the outsole, and also cemented to the upper portion of the shoe. In this embodiment, the outsole and second material combination form a completed sole having the embedded receptacles.

In some embodiments, the shoe sole may be formed of light-weight materials such is EVA or foam. In such embodiments, the sole material may be insufficiently strong to hold a receptacle firmly in place. Consequently, in preferred embodiments, a support plate may be added to the sole structure, wherein the receptacles are attached to the plate at the desired locations, and the sole is formed around the attached receptacles. Such plates may also be used for heel support for footwear having light-weight heels; similarly, for heel-plates, support-pins may also be used to help prevent heel receptacle deformation.

Figure 19:
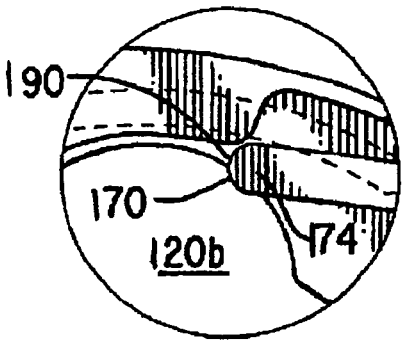
FIG. 19 is a partial view of a FIG. 12A cleat inserted into a FIG. 15A receptacle.
Figure 20:
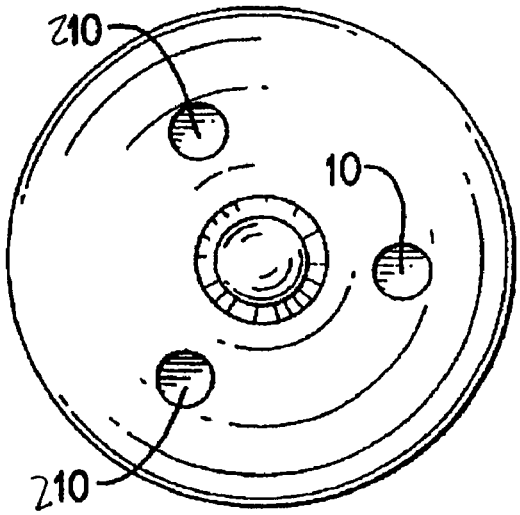
FIG. 20 is a bottom view of the FIG. 12A cleat.

FIG. 19 is a partial view of a FIG. 12A cleat inserted into a FIG. 15A receptacle. Shown is a magnified view of the end portion 190 of a cantilevered finger 174 at rest in indentation 170 of retaining member 120*b*. As described hereinabove, after installation of a cleat into a receptacle, the torque required to dislodge the cantilevered finger 174 from the indentation 170 is much greater than that required during installation.

FIG. 10, a bottom view of the FIG. 12A cleat, shows that in this embodiment of the invention, a three-pronged wrench is inserted into the three wrench holes 210 used to remove the cleat. Use of a three-wrench-hole design gives greater stability during insertion and removal of a cleat, and allows greater torque to be applied, without slipping out of the holes, during such insertion and removal.

Figure 21:
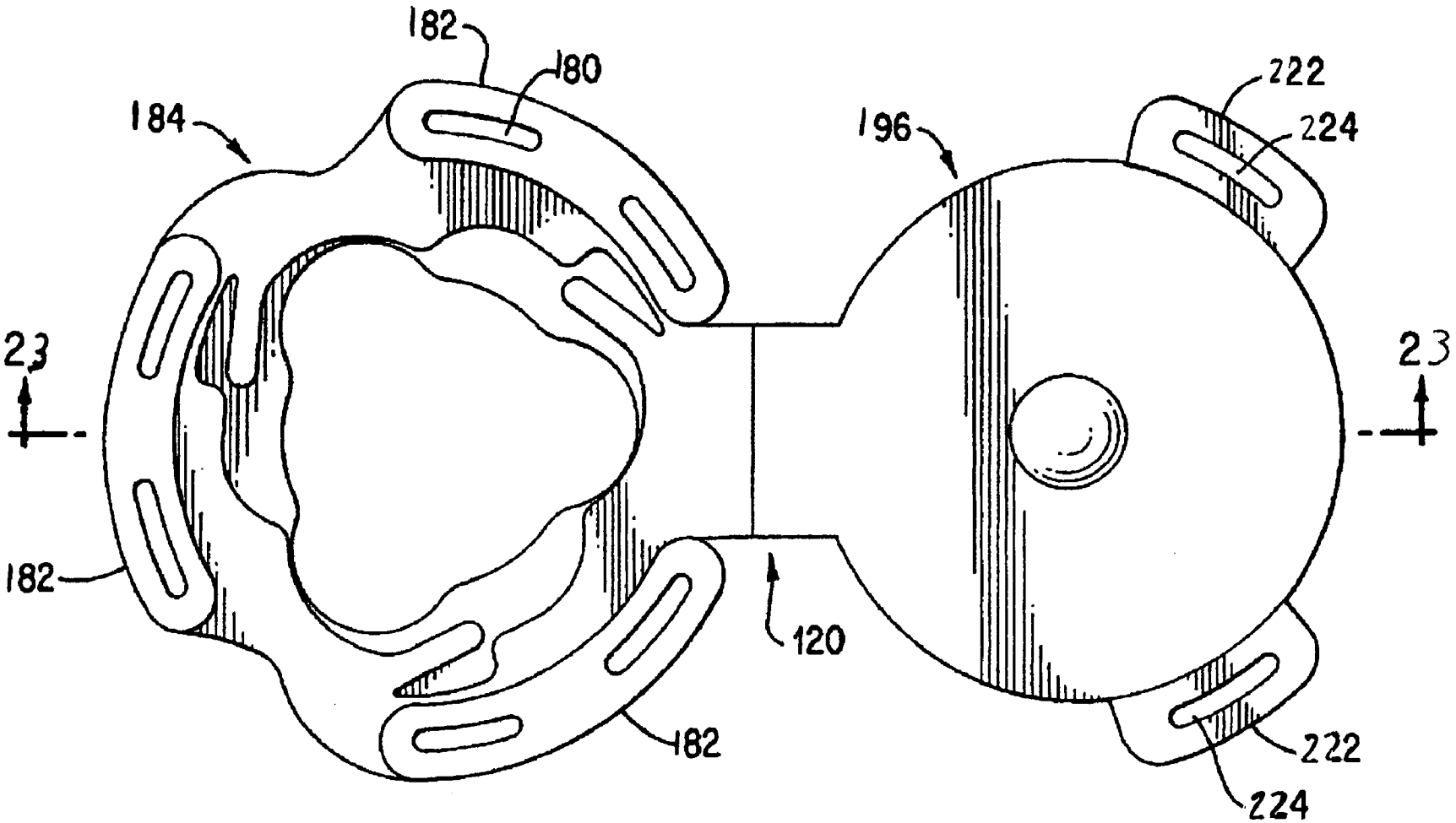
FIG. 21 is a top view of an unassembled receptacle for receiving the FIG. 12A cleat.

FIG. 21 is a top view of an alternate embodiment where a modified FIG. 17 cover is attached to the FIG. 15A receptacle through a flexible attachment region 220. In this embodiment, the receptacle 184 and cover 196 may be integrally formed of a single portion of production material, and simultaneously formed from a single mold. Before insertion of this embodiment of the receptacle into a shoe sole, the cover is flipped closed to cover the top of the receptacle. The FIG. 15 cover is modified to include two cover flanges 222 which, when the cover is closed, rest in-between two of the receptacle flanges 182. The cover flanges 222 also have slots 224, which in addition to the receptacle slots 180 described hereinabove, are used for mounting the FIG. 21 combined receptacle and cover to the underside of footwear.

Figure 22:
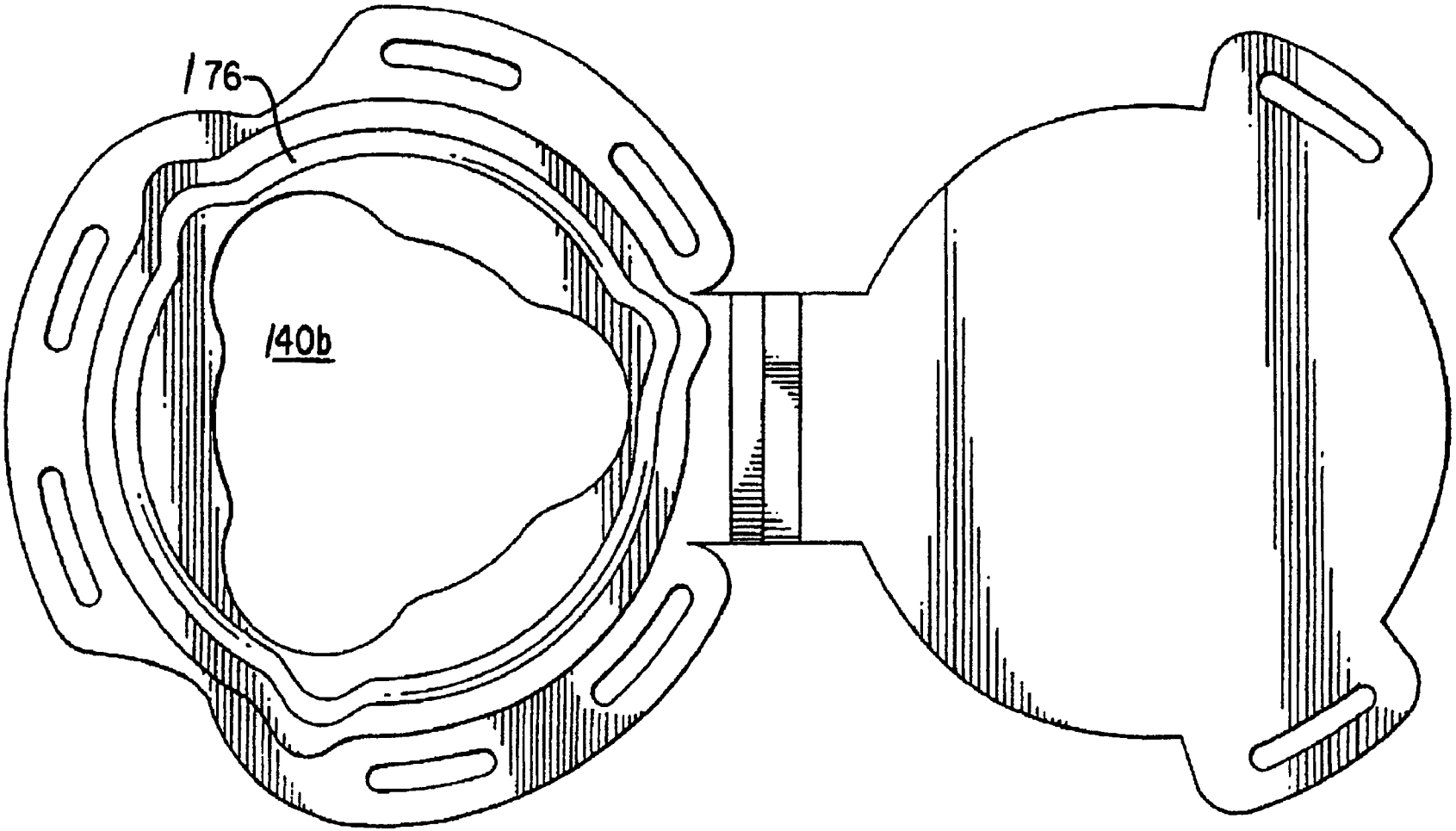
FIG. 22 is a bottom view of the FIG. 21 receptacle.

FIG. 22 is a bottom view of the FIG. 21 embodiment, showing the ridge 176 (see FIG. 16 hereinabove) which helps prevent sole material from the outsole molding process from accidentally spilling in over the bottom-end of the receptacle opening 140*b* with attached FIG. 15 cover having the features as disclosed hereinabove for FIG. 15A and FIG. 17.

Figure 23:
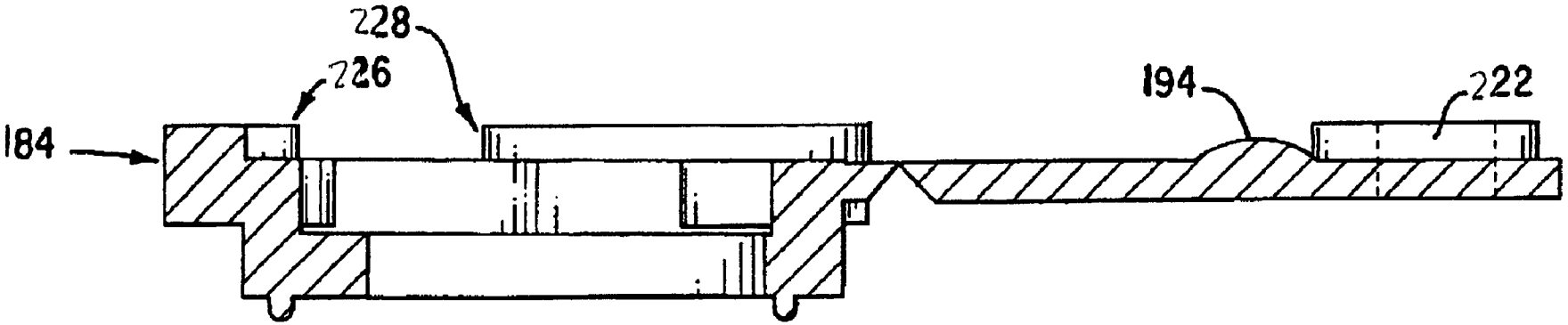
FIG. 23 is a section view of the FIG. 21 receptacle.

FIG. 23 is a top section view of FIG. 21, showing the relationship between the extent of the dome 194 and the receptacle 184. Also shown is the region defined by portions 226, 228 for receiving the cover flange 222 when the cover is closed over the receptacle 184.

The above description of the drawings provides details of several embodiments of the present invention. It is of course apparent that the present invention is not limited to the detailed description set forth above. Various changes and modifications of this invention as described will be apparent to those skilled in the art without departing from the spirit and scope of this invention as defined in the following claims.

What is claimed is:

1. A system for securing a reversible cleat, comprising:

a securing mechanism;

an anchoring mechanism adapted to be attached to a sole of a shoe;

a cleat having a first side and a second side, each side having at least one extension;

said cleat includes a hole through which said securing mechanism is placed;

wherein said second side faces toward said anchoring mechanism when said securing mechanism is removably secured to said anchoring mechanism; and wherein said second side is repositioned to face away from said anchoring mechanism by removing said securing mechanism from said anchoring mechanism, removing and repositioning said cleat with said second side facing away from said anchoring mechanism, and removably securing said securing mechanism to said anchoring mechanism.

2. The system according to claim 1, wherein, in a first position, said securing mechanism is in contact with said first side when secured to said anchoring mechanism and, in a second position, said securing mechanism is in contact with said second side when secured to said anchoring mechanism.

3. The system according to claim 1, said cleat further includes a rigid material having a first side and a second side corresponding to said first and second sides of said cleat.

4. The system according to claim 3, wherein said securing mechanism is adapted to contact both said first and said second sides of said rigid material when removably securing said cleat to said anchoring mechanism.

5. The system according to claim 1, further comprising a plurality of cleats, each cleat of said plurality of cleats being removably interchangeable with said cleat.

6. The system according to claim 5, further comprising a selected cleat from said plurality of cleats wherein said selected cleat is interchangeable with said cleat.

7. A system for securing a reversible cleat, comprising:

a securing mechanism;

an anchoring mechanism adapted to be attached to a sole of a shoe;

said securing mechanism having a sole side with at least one extension extending from said sole side;

said anchoring mechanism having at least one pocket;

a cleat having a first side and a second side, each side having at least one extension;

said cleat is placed between said securing mechanism and said anchoring mechanism;

wherein said second side faces toward said anchoring mechanism when said at least one extension of said securing mechanism is removably placed in said at least one pocket of said anchoring mechanism; and wherein said second side is repositioned to face away from said anchoring mechanism by removing said at least one extension of said securing mechanism from said at least one pocket of said anchoring mechanism, removing and repositioning said cleat with said second side facing away from said anchoring mechanism, and removably placing said at least one extension of said securing mechanism in said at least one pocket of said anchoring mechanism.

8. The system according to claim 7, wherein said first side has physical characteristics different from said second side.

9. The system according to claim 7, wherein said anchoring mechanism has 3 pockets and said securing mechanism has 3 extensions.

10. A system for securing a reversible cleat, comprising:

a securing mechanism;

an anchoring mechanism adapted to be attached to a sole of a shoe;

a cleat having a first side and a second side, each side having at least one extension;

said cleat includes a hole through which said securing mechanism is placed;

said cleat includes a rigid material having a first shoulder and a second shoulder, each shoulder alternately coming in contact with said securing mechanism when said securing mechanism is removably secured to said anchoring mechanism;

wherein said second side faces toward said anchoring mechanism when said securing mechanism is removably secured to said anchoring mechanism; and wherein said second side is repositioned to face away from said anchoring mechanism by removing said securing mechanism from said anchoring mechanism, removing and repositioning said cleat with said second side facing away from said anchoring mechanism, and removably securing said securing mechanism to said anchoring mechanism.

* * * * *